United States Patent [19]

Nielsen et al.

[11] Patent Number: 4,711,446

[45] Date of Patent: Dec. 8, 1987

[54] STILT

[76] Inventors: Orlan S. Nielsen, Box 101, Parker, Id. 83438; Lawrence E. Nielsen, 1916 Amsterdam La., Modesto, Calif. 95356

[21] Appl. No.: 832,668

[22] Filed: Feb. 25, 1986

[51] Int. Cl.[4] ..... A63B 25/00

[52] U.S. Cl. ..... 272/70.1

[58] Field of Search ..... 272/70.1, 70.2, 70, 272/109, 93, 114

[56] References Cited

U.S. PATENT DOCUMENTS

| | | | |
|---|---|---|---|
| 381,552 | 4/1888 | Hoffman . | |
| 652,503 | 6/1900 | Benjamin | 272/70.2 |
| 661,891 | 11/1900 | Parker . | |
| 1,710,293 | 4/1929 | Byles | 272/70.2 |
| 3,186,710 | 6/1965 | St. Peter . | |
| 3,441,272 | 4/1969 | Mann . | |
| 3,667,755 | 6/1972 | Manning . | |
| 3,751,032 | 8/1973 | Boyle | 272/70.1 |
| 3,831,937 | 8/1974 | Jones . | |

*Primary Examiner*—Richard J. Apley
*Assistant Examiner*—S. R. Crow
*Attorney, Agent, or Firm*—Fleit, Jacobson, Cohn & Price

[57] ABSTRACT

An upright standard is provided having upper and lower end portions and inner and outer upstanding longitudinal sides. A horizontally outwardly projecting foot block is guidingly mounted from the inner side of the standard for movement therealong and a generally rectangular bail closely encircles the standard and foot block and includes transverse opposite end members. The longitudinal groove which runs the length of the upright standard also provides finger grip. The remote oppositely facing sides of the foot block and the standard include horizontal support and adjustment grooves, respectively, formed therein and the opposite end members of the bail are seated in the support groove and one of the adjustment grooves with the latter spaced above the support groove.

9 Claims, 4 Drawing Figures

STILT

BACKGROUND OF THE INVENTION

1. Field of the Invention

This invention relates to a stilt including a laterally outwardly projecting foot block supported from an upright standard for guided movement therealong and incorporating a rectangular rigid bail passing about the upright and the foot block and including opposite end transverse portions seated in an outwardly opening groove formed in the foot block and selectively seatable in transvere horizontal grooves formed in and spaced along the side of the standard remote from the foot block.

2. Description of Related Art

Various different forms of stilts heretofore have been provided including some of the general structural and operational features of the instant invention. Examples of such previously known forms of stilts are disclosed in U.S. Pat. Nos. 381,552, 661,891, 3,186,710, 3,441,272, 3,667,755 and 3,831,937.

However, these previously known forms of stilts do not include the overall combination of structural features of the instant invention which enable ready adjustment of the height of the foot block of the stilt along the standard thereof.

SUMMARY OF THE INVENTION

The stilt of the instant invention may be constructed of wood and other suitable materials and includes an upright having a first side horizontally outwardly from which a foot block projects. The first side of the upright and the opposing side of the foot block include a tongue and groove connection enabling guided shifting movement of the block along the upright and a generally rectangular rigid bail is provided including opposite end transverse members. The bail encircles the foot block and the standard and has one end member seated in an outwardly opening transverse horizontal support groove formed in the outer side of the foot block. The side of the standard remote from the foot block includes vertically spaced horizontally outwardly opening adjustment grooves in which the other end member of the bail is selectivey engageable and the length of the bail between the end members thereof is such to enable the bail to be downwardly and outwardly inclined from the standard when the end members of the bail are seated in the foot block groove and a selected standard groove. In addition, the standard includes bail end member retaining structure which may be used to releasably retain the corresponding bail end member in a selected adjustment groove against accidental dislodgement therefrom.

The main object of this invention is to provide a stilt including a vertically adjustable foot block and structure whereby vertical adjustment of the foot block along the standard may be readily accomplished.

Another object of this invention is to provide a stilt including a foot block having an outer side upwardly projecting curb mounted therefrom.

Yet another important object of this invention is to provide a stilt in accordance with the preceding objects and including means by which the adjusted position of the foot block along the stilt may be retained during usage of the stilt while still enabling ready adjustment of the foot block height along the stilt standard.

A further object of this invention is to provide a stilt including a readily adjustable foot block and foot block adjustment retaining means of such construction to enable ready operation thereof by young children.

Another object of this invention is to provide a stilt standard including a longitudinal groove to facilitate a finger grip thereon by children.

A final object of this invention to be specifically enumerated herein is to provide a stilt in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
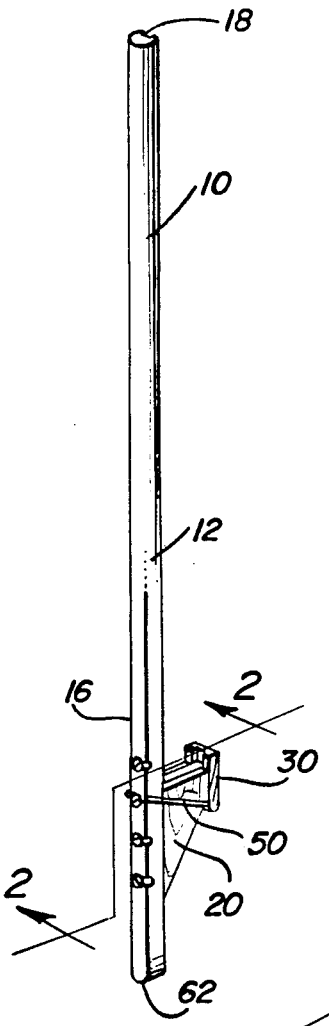
FIG. 1 is a perspective view of the stilt.

Referring now more specifically to the drawings, the numeral 10 generally designates a stilt constructed in accordance with the present invention. The stilt 10 includes a standard 12 including remote inner and outer sides 14 and 16 and the inner side 14 includes a longitudinal groove 18 formed therein and extending the length of the standard 12.

The stilt 10 additionally includes a foot block 20 extending along and projecting horizontally outwardly of the inner side 14 and the foot block 20 includes a first side 22 abutted against the inner side 14 and having a tongue or ridge 24 extending therealong slidingly seated in the groove 18. In addition, the foot block 20 includes a second side 26 remote from the first side 22 equipped with a tongue or ridge 28 and a vertically disposed curb block 30 opposes the second side 26 and includes a groove 32 formed therein in which the tongue or ridge 28 is seated, the curb block 30 being glued or otherwise stationarily anchored to the outer side of the foot block 20.

Figure 2:
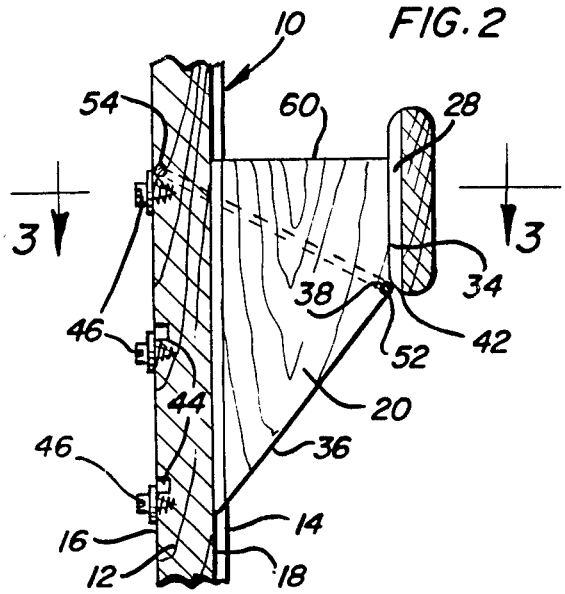
FIG. 2 is a fragmentary enlarged vertical sectional view taken substantially upon the plane indicated by the section line 2—2 of FIG. 1.
Figure 3:
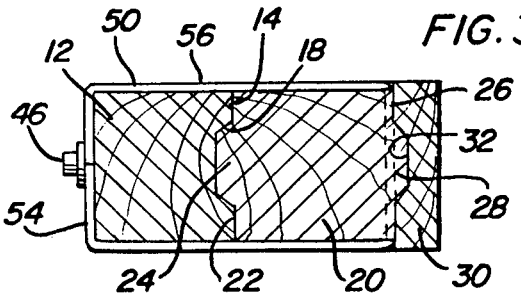
FIG. 3 is a horizontal sectional view taken substantially upon the plane indicated by the section line 3—3 of FIG. 2.
Figure 4:
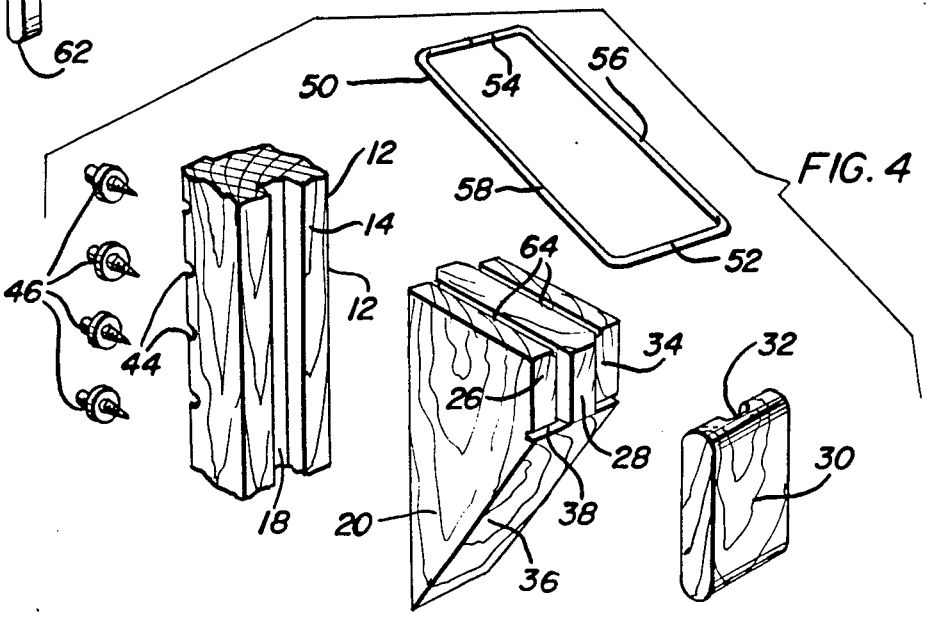
FIG. 4 is an exploded perspective view of the various components of the stilt with the standard of the stilt being fragmentarily illustrated, only.

The second side of the foot block 20 includes a vertical upper end portion 34 from which the tongue or ridge 28 is supported and a downwardly and inwardly inclined lower end portion 36. Further, the second side 26 of the foot block 20 includes a horizontal transverse groove 28 formed therein at the intersection between the upper end portion 34 and the lower end portion 36. The groove 38 opens horizontally outwardly of the second side 26 and is partially shielded by the lower end of the curb block 30. The lower end of the curb block 30 is rounded as at 40 and defines, in conjunction with the upper extremity of the lower end portion 36, a downwardly and outwardly opening pocket 42 into which the groove 38 opens, see FIG. 2.

The outer side 16 of the lower end of the standard 12 includes vertically spaced horizontally outwardly opening notches 44 formed therein and each notch 44 has a washer equipped screw member 46 threadedly engaged in the standard 12 operatively associated therewith in such a manner that the washer portion of each screw member 46 at least partially closes the outer side of a corresponding groove 44.

An elongated open frame-type rigid bail 50 is provided including opposite end transverse members 52 and 54 and opposite side longitudinal members 56 and 58. The bail 50 encirles about the foot block 20 and the adjacent portion of the standard 12. The end member 52 is seated in the groove 38 and the end member 54 is seated in a selected groove 46 and releasably retained therein by the washer portion of the corresponding threaded screw member 46. Further, as may be seen from FIGS. 1 and 2 of the drawings, the bail 50 is downwardly inclined toward the transverse end member 52. Thus, any downward force applied to the horizontal upper surface 60 of the foot block 20 tends to cause the foot block 20 to be more tightly abutted against the inner side 14 of the standard 12. Of course, in order to adjust the height of the foot block 20 along the standard, it is necessary to loosen the threaded member 46 retaining the end member 54 in the corresponding groove 44 and to slightly upwardly displace the foot block 20 to enable the end member 54 to be unseated from the groove 44. Thereafter, the bail 50, while the end member 52 remains seated in the groove 38, may be swung to a horizontal position in order to allow the foot block 20 to be shifted along the inner side 14 of the standard 12 to a position with the end member 54 registered with a different groove 44. Thereafter, the foot block 20 may be shifted downwardly relative to the standard 12 in order to seat the end member 54 in the groove 44 with which it is now registered in order to fully seat the end member 54 therein. Thereafter, the corresponding threaded member 46 may be tightened to insure that the end member 54 is retained within the groove 44.

The pocket 42 insures that the end member 52, if accidentally dislodged from the groove 38, will be automatically reseated in the groove 38 upon downward pressure being applied to the upper surface 60 of the block 20. Further, the upper surface 60 is provided with parallel saw cuts 64 formed therein in order to form a non-slip surface and the lower end of the standard is rounded at 62, see FIG. 1.

The components 12, 20 and 30 of the stilt 10 may be constructed of any suitable material such as wood or plastic. However, it is preferable that the bail 50 be constructed of metal or at least of a very strong and durable plastic.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A stilt including an upright standard having upper and lower end portions and upstanding inner and outer longitudinal sides, said outer longitudinal side including horizontal outwardly opening adjustment grooves formed therein and spaced vertically along said lower end portion, a foot block including a first side opposing, abutted against and slidable along the inner side of said standard, said foot block including a second side remote from said standard, said second side including a horizontal outwardly opening support groove formed therein, an elongated closed loop-type bail closely encircled about said standard and block and including opposite end transverse portions thereof seated in one of said adjustment grooves and said support groove with said support groove spaced sufficiently below said one adjustment groove to enable one of said transverse portions to be displaced outward of the corresponding groove upon upward displacement of said block along said standard to a position with said support groove generally horizontally aligned with said one adjustment groove, said foot block including a curb member mounted from the second side of said foot block and projecting upwardly above the upper extremity of said foot block, said curb member projecting slightly downwardly below the level of said support groove and partially obstructing the displacement of the corresponding end transverse portion of said bail from said support groove.

2. The stilt of claim 1 wherein the opposing sides of said standard and foot block include slidingly engaged tongue and groove portions for guided movement of said foot block along said standard.

3. The stilt of claim 2 wherein said groove portion comprises a longitudinal groove formed in said standard and extending at least substantially the full length thereof and also serving as a finger grip.

4. The stilt of claim 1 wherein said foot block includes a generally horizontal upper surface, said upper surface including grooves formed therein to increase foot traction on said foot blocks.

5. The stilt of claim 3 including means carried by said standard adjacent each of said adjustment grooves and operable to releasably close the corresponding adjustment groove against the displacement of the corresponding end member of said loop-type bail therefrom, the opposing sides of said standard and foot block including slidingly engaged tongue and groove portions for guided movement of said foot block along said standard, said foot block including a generally horizontal upper surface, said upper surface including grooves formed therein to increase foot traction on said foot blocks, and means carried by said standard adjacent each of said adjustment grooves and operable to releasably close the corresponding adjustment groove against the displacement of the corresponding end member of said loop-type bail therefrom.

6. A stilt including an upright standard having upper and lower end portions and upstanding inner and outer longitudinal sides, said outer longitudinal side including horizontal outwardly opening adjustment grooves formed therein and spaced vertically along said lower end portion, a foot block including a first side opposing, abutted against and slidable along the inner side of said standard, said foot block including a second side remote from said standard, said second side including a horizontal outwardly opening support groove formed therein, an elongated closed loop-type bail closely encircled about said standard and block and including opposite end transverse portions thereof seated in one of said adjustment grooves and said support groove with said support groove spaced sufficiently below said one adjustment groove to enable one of said transverse portions to be displaced outward of the corresponding groove upon upward displacement of said block along said standard to a position with said support groove generally horizontally aligned with said one adjustment groove, means carried by said standard adjacent each of said adjustment grooves and operable to releasably close the corresponding adjustment groove against the displacement of the corresponding end member of said loop-type bail therefrom.

7. The stilt of claim 6 wherein the opposing sides of said standard and foot block include slidingly engaged tongue and groove portions for guided movement of said foot block along said standard.

8. The stilt of claim 7 wherein said foot block includes a generally horizontal upper surface, said upper surface including grooves formed therein to increase foot traction on said foot blocks.

9. A stilt including an upright standard having upper and lower end portions and upstanding inner and outer longitudinal sides, said outer longitudinal side including transverse, horizontal outwardly opening adjustment grooves formed therein and spaced vertically along said lower end portion, a foot block including a first side opposing, abutted against and slidable along the inner side of said standard, said foot block including a second side remote from said standard, said second side including a transverse, horizontally outwardly opening support groove formed therein, an elongated closed loop-type bail closely encircled about said standard and block and including opposite end transverse portions thereof seated in one of said adjustment grooves and said support groove with said support groove spaced sufficiently below said one adjustment groove to enable one of said transverse portions to be displaced outward of the corresponding groove upon upward displacement of said block along said standard to a position with said support groove generally horizontally aligned with said one adjustment groove, and means carried by said standard adjacent each of said adjustment grooves and operable to releasably close the corresponding adjustment groove against the displacement of the corresponding end member of said loop-type bail therefrom.

* * * * *